United States Patent [19]

John, deceased et al.

[11] Patent Number: 4,520,539

[45] Date of Patent: Jun. 4, 1985

[54] DEVICE FOR SEPARATING AND DELIVERING INDIVIDUAL HEDDLES TO A DRAW-IN POSITION

[75] Inventors: Heinz John, deceased, late of Berneck, Switzerland; Friedlinde John née Rueffler, heiress, Gams, Switzerland

[73] Assignee: Lindauer Dornier Gesellschaft mbH, Lindau, Fed. Rep. of Germany

[21] Appl. No.: 430,287

[22] Filed: Sep. 30, 1982

[30] Foreign Application Priority Data

Oct. 6, 1981 [DE] Fed. Rep. of Germany ..... 3139625

[51] Int. Cl.[3] ..... D03J 1/14

[52] U.S. Cl. ..... 28/206

[58] Field of Search ..... 28/205, 206, 207

[56] References Cited

U.S. PATENT DOCUMENTS 4,047,270 9/1977 Heinz ..... 28/205

4,197,621 4/1980 Mair ..... 26/98

FOREIGN PATENT DOCUMENTS 2339586 6/1977 Fed. Rep. of Germany .

2109426 6/1983 United Kingdom ..... 28/207

*Primary Examiner*—Robert R. Mackey

*Attorney, Agent, or Firm*—W. G. Fasse; D. H. Kane, Jr.

[57] ABSTRACT

The invention concerns a device for individually separating heddles bunched into packs and arranged on heddle slide rails, the lifting of individual heddles from the pack being implemented by suction nozzles and the heddles being moved into position for drawing-in the associated warp threads. A blow tube is provided to generate the suction effect and is angularly bent at its front end constructed as a blow nozzle. A small tube is so inserted into the wall of the angular bend that its part within the wall of the tube forms an ejector nozzle and its external end acts as a suction nozzle to lift individual heddles off a pack. The blow nozzle may be brought into line with the direction of advance of the heddles whereby a blast of air issuing from the blow nozzle effects the further motion of a lifted heddle following the drawing-in of the warp thread.

6 Claims, 7 Drawing Figures

DEVICE FOR SEPARATING AND DELIVERING INDIVIDUAL HEDDLES TO A DRAW-IN POSITION

FIELD OF THE INVENTION

This invention relates to a device for individually separating drop wires or heddles bunched into packs and arrayed on heddle slide rails, using individual separating means associated with the individual packs for first lifting the foremost drop wire or heddle of a pack by a discrete extent from the pack and then moving it into a position for drawing-in a warp thread. Such device comprises a pair of tubes displaceable parallel to the packs, rotatable about their longitudinal axes, and provided with suction nozzles at their bent-around ends.

DESCRIPTION OF THE PRIOR ART

Such devices are preferably used to separate heddles in warp thread draw-in apparatuses of looms. The heddles are tightly packed into groups or rows abutting one another and resting on heddle frames, and hence it is necessary to separate each individual heddle from a pack and move it away from the pack. The separated and removed heddles in this manner are brought into a predetermined draw-in position whereby the eye arranged in the heddle for receiving a warp thread is moved into a position required for the threading or draw-in position.

German Patent Publication No. 2,339,586 corresponding to U.S. Pat. No. 4,047,270 discloses such a device for individually separating heddles. In the known device, the foremost heddle or lamina of a pack of heddles or laminae combined on one or more slide rails, is lifted from this pack by two suction nozzles and thereupon, it is held by a magnetic force and moved into the warp thread draw-in position. The suction nozzles are mounted at the ends of two bent-around blow tubes similar to the shape of a walking cane, the blow tubes being displaceable parallel to the packs and rotatably about their longitudinal axes. Accordingly, the suction nozzles can be pivoted from a side position into the advance path of the heddles and moved ahead of the foremost heddle of the pack. The foremost heddle is lifted off its pack by suction, which may be reinforced by a slight magnetic force from an accessory magnet mounted to the suction nozzle. Thereafter the lifted heddle is removed from the pack by longitudinally displacing the tube away from the pack and bringing the heddle into the effective range of a more powerful magnet which displaces the heddle in a fully reliable manner into the draw-in position and maintains it there for the time of the warp thread draw-in procedure. After the warp thread has been threaded into the heddle, the bent-around ends of the tube together with the suction nozzles mounted thereto and also the magnetic means are pivoted back into the side position and withdrawn into their initial position.

However, this known apparatus has certain difficulties in generating the suction effect. While the steady generation of a suction effect can be relatively easily achieved, it is uneconomical for the present case. Alternatingly turning on and off the suction force is substantially more costly in the required construction and also uneconomical.

SUMMARY OF THE INVENTION

Starting from the above-cited apparatus of German Patent Publication No. 2,339,586, it is the object of the present invention to simplify the generation of the suction force and to make it more economical. This problem is solved by the present invention in that at least one of the tubes is constructed as a blow line and it comprises at its bent-around end, a blow nozzle directed in the advance direction of the heddles, and an oppositely directed suction nozzle. The suction nozzle is inserted as an ejector nozzle into the blow nozzle. To achieve the ejector effect, advantageously a small suction nozzle tube of a lesser cross-section than the respective blow tube is inserted from the outside into the blow tube of larger cross-section at its point of curvature. The small suction nozzle tube in this manner passes through the wall of the blow tube within which it extends approximately as far as the end of the curvature of the bent end of the blow tube.

The present invention substantially simplifies the generation of the suction effect by means of the ejector nozzle because it is much easier to supply a blow tube with the required compressed air, and to control it, than to directly generate a suction force in a tube or pipe. Another advantage moreover is obtained in that the blow nozzle blows the heddle, after the termination of the draw-in procedure, from the draw-in position into a new position that does not adversely affect subsequent draw-in procedures.

BRIEF DESCRIPTION OF THE DRAWINGS

The invention will be further illustrated by reference to the accompanying drawings, in which.

Figure 1:
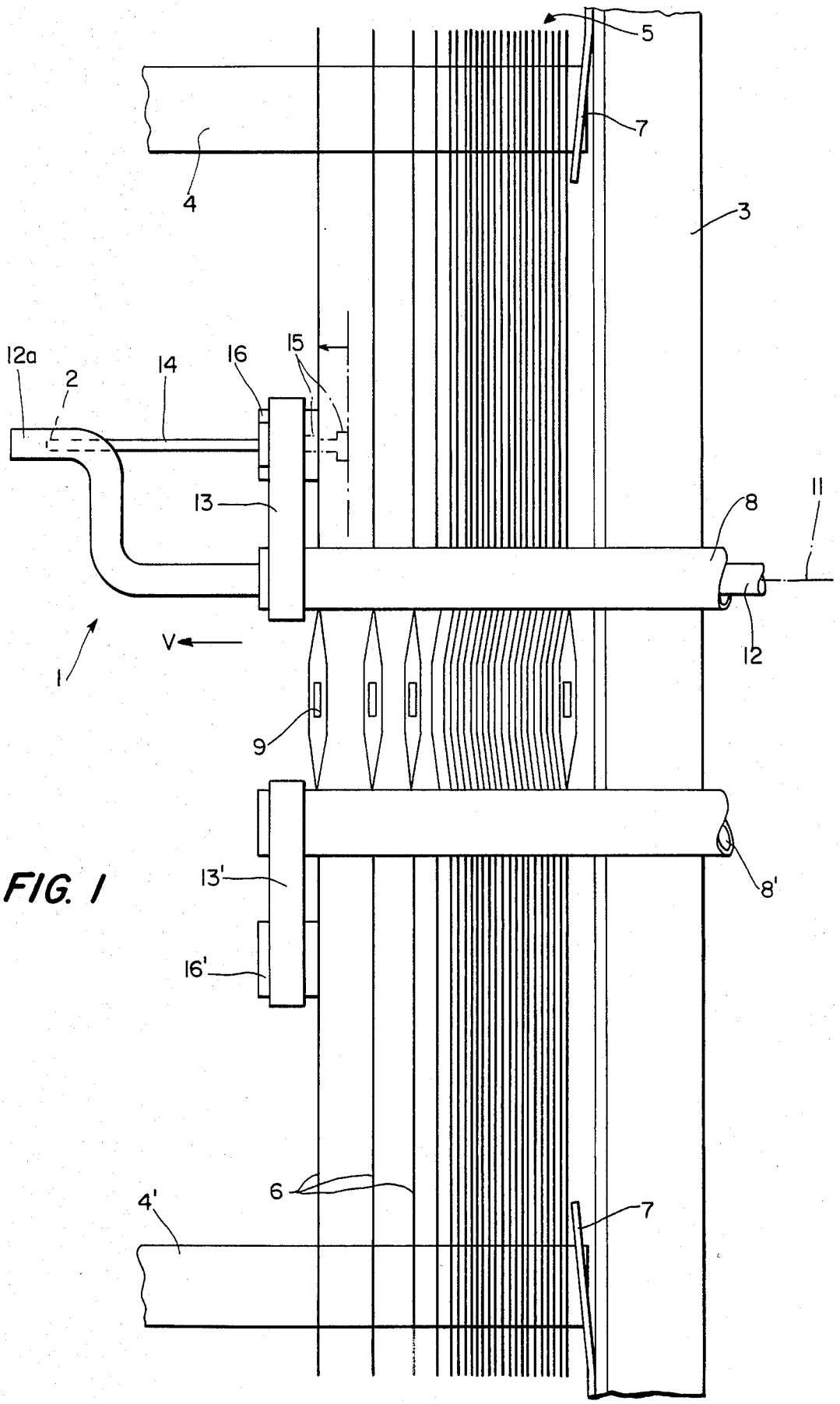
FIG. 1 is a side view of the device.
Figure 2A:
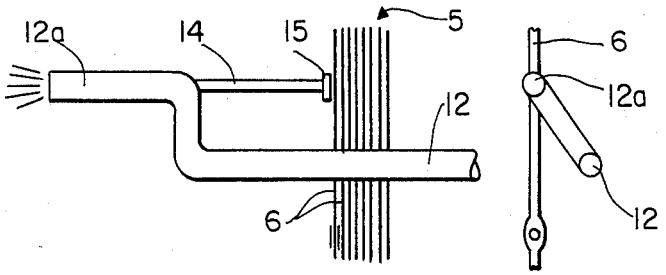
Figure 2B:
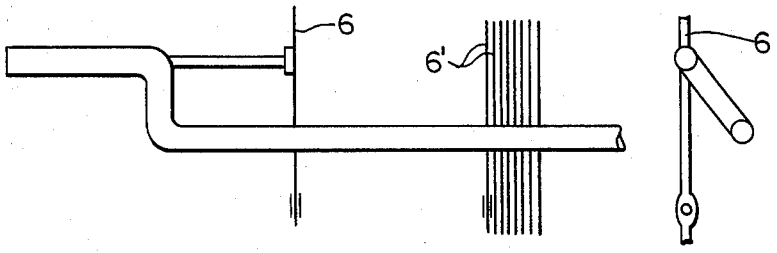
Figure 2C:
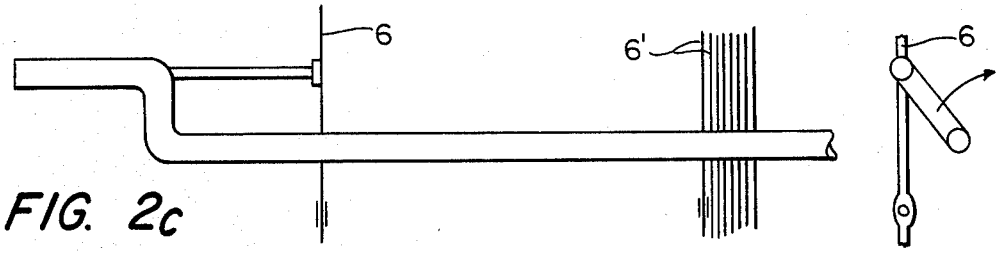
Figure 2D:
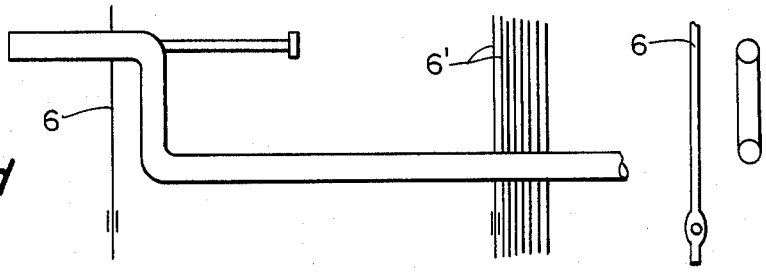
Figure 2E:
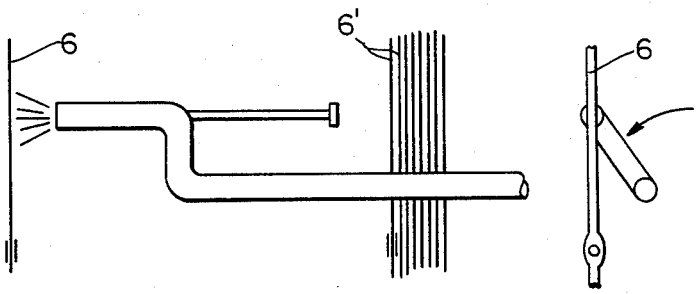
Figure 2F:
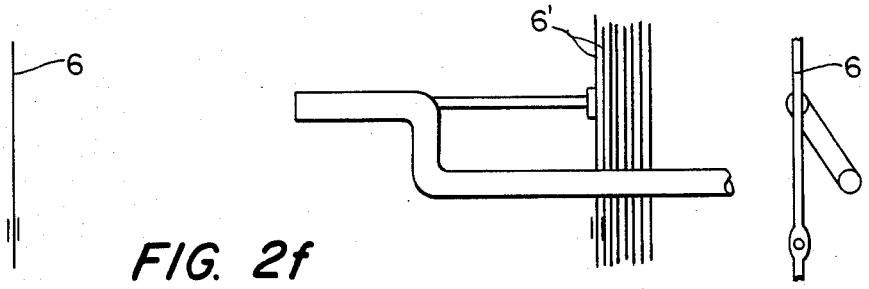

FIGS. *2a* to *2f* show various positions of the device during one operational cycle, in a very simplified manner.

DETAILED DESCRIPTION OF PREFERRED EXAMPLE EMBODIMENTS AND OF THE BEST MODE OF THE INVENTION

The device will be first described with reference to FIG. 1. An upper and a lower heddle slide rail 4 and 4' respectively are mounted in conventional manner to a heddle frame 3 shown only in part. Heddles 6 are arrayed on these slide rails and are bunched into a pack near the heddle frame 3. The heddles 6, i.e., the pack 5, rest against the heddle frame 3 or against a leaf spring 7. Viewed from the narrow side, the heddles 6 are conventionally twisted, whereby this part appears somewhat broader in FIG. 1 and discloses the eyes 9 of the heddles.

A separation device 1 for the heddles 6 is mounted in the upper part of the pack of heddles and essentially comprises a guide tube 8 within which is arranged a blow tube 12. The blow tube 12 is displaceable within the guide tube 8 in the direction of advance V and moreover it is rotatable together with the guide tube 8 about its axis 11. The connection fitting of the blow tube 12 outside the heddle is constructed in known manner and not shown here in further detail. The fore end of the blow tube 12 is angularly bent and forms a blow nozzle 12*a*. A small tube 14 or lesser cross-section than the blow tube 12 passes through the wall of the blow tube 12 in its upper curvature of the bent end in such a manner that the inside end extends approximately as far as the end of the curved part of the blow tube 12 by which it is annularly enclosed. In this manner, the inside end 2 of the small tube 14 becomes an ejector nozzle when air is blown through the blow tube 12. A suction effect is correspondingly created at the other end of the small tube 14.

An arm 13 is mounted to the end of the guide tube 8 and is pivoted from a position to the side of the pack 5 into an operational position in front of the forward end of the pack 5 upon rotation of the guide tube 8. An annular holding magnet 16 is mounted to the end of the arm 13. The small suction tube 14 passes through a magnet 16. As stated, the blow tube 12 is arranged within the guide tube 8 so as to be displaceable in the direction of advance V. The magnitude of the displacement is such that in the retracted position the small suction tube 14 passes through the annular holding magnet 16 and through the arm 13 to the rear toward the pack 5 until the end of the small suction tube 14 is located in front of the foremost heddle 6 and grabs it by suction. When the blow tube 12 is advanced, the guide tube 8 with its arm 13 initially remains in its assumed position, while the small suction tube 14 is withdrawn by the blow tube 12, until the lifted foremost heddle 6 arrives in the range of the holding magnet 16 and will be held by it in problem-free manner.

The drawing of FIG. 1 indicates only one separating device 1 of the above described type which is arranged in the upper part of the pack 5. However, another such separating device can be mounted in the lower part of the pack 5 nearly symmetrically to the axis passing through the heddle eyes 9. In this example, a simplified embodiment is assumed, for which only one guide tube 8' with arm 13' and holding magnet 16' is provided. Such a simplified form can be selected when the upper separating device 1 ensures a problem-free lifting of the foremost heddle 6 from the pack 5 and and reliably moves the heddle along the direction of advance V to the holding magnet 16. This effect, where appropriate, can be reinforced by a small suction-nozzle magnet 15 at the end of the small suction-nozzle tube 14.

The moment the withdrawn heddle has been reliably secured by the holding magnet 16, and possible 16', the guide tubes 8 and 8' are advanced by conventinal means in the direction V together with the blow tube 12, and the withdrawn heddle 6 is moved into the position for drawing-in the associated warp thread. Once the warp thread has been drawn-in, the two guides tubes 8 and 8' are pivoted back again, whereby the arms 13 and 13' again will lie outside the plane of the pack 5; thereupon the separating devices 1 are returned into their initial positions to lift the next heddle.

The operation of the device will now be described with reference to FIGS. *2a* to *2f*. These figures are much simplified and only the most significant reference numerals from FIG. 1 have been retained. Each partial figure comprises a side view and to the right of it a front view. These figures show a pack 5 of heddles 6, the blow tube 12 with its bent blow nozzle end 12*a*, the rearwardly extending small suction nozzle tube 14, and a suction nozzle magnet 15 mounted to the end of the small tube 14. For the sake of clarity, the guide tube 8, the arm 13 and the holding magnet 16 are omitted.

FIG. *2a* shows that position wherein the small suction nozzle tube 14 together with its suction nozzle magnet 15 is located directly in front of the foremost heddle 6 of the pack 5. A blast through the blow tube 12 generates an ejector effect and thereby a suction effect at the end of the small suction nozzle tube 14. As a result the foremost heddle 6 is lifted off of the pack 5.

FIG. *2b* shows the blow tube 12 advanced in the direction V into a first phase of motion and it is assumed that the lifted heddle 6 meantime was secured by the holding magnet 16 only shown in FIG. 1. In a second phase, the blow tube 12 together with the holding magnet 16 is further advanced until the heddle 6 reaches the draw-in position for the warp thread. This position is shown in FIG. *2c*. The process of threading the warp thread is not shown in further detail nor need it be described further inasmuch as it is without significance for the invention. The front view of FIG. *2c* shows a rotational arrow which indicates that presently the bent-around end of the blow tube 12 has been pivoted-out and hence the threaded heddle 6 is being released. This pivoting-out motion initiates the third motion phase.

As shown in FIG. *2d*, the blow tube 12 together with the small suction nozzle tube 14 is laterally withdrawn next to the heddle 6 until the end 12*a* of the blow tube arrives behind the location of the released heddle 6, whereby the position of FIG. *2e* has been approximately reached. Thereupon the blow tube 12 is again pivoted in front of the pack 5, the blow nozzle 12*a* being located behind the threaded heddle 6 whereby the released heddle is moved by blowing away from the draw-in position and in the direction of advance V. This terminates the third phase of motion shown in FIG. *2f*, the blow tube 12 also having been withdrawn to such an extent that the end of the small suction nozzle tube 14 is located directly in front of the presently foremost heddle 6' of the pack 5. Accordingly, FIG. *2f* corresponds to the intiial state of FIG. *2a* for a new separation process for the next heddle, beginning with the first phase of motion.

When the separation device includes the holding magnets 16, 16' shown in FIG. 1, the blow tube 12 may be operated intermittently, a blast from the blow nozzle 12*a* then being simultaneous with a suction at the suction nozzle 14. Such an effect need be maintained only until the foremost heddle is lifted, as indicated in FIGS. *2a* and *2b*, and ismoved into the range of the holding magnets 16 or 16'. The further displacement into the threading position can be carried out without blowing. Blowing will be required again only when the separating device is withdrawn into the positions shown in FIGS. *2e* and *2f*, in order to move the threaded heddle on and to lift the next one. In this manner, however, the next operational stage has been initiated. On the other hand, if for some reason the holding magnets 16 or 16' are dispensed with, a suction effect must be constantly present at the suction tube 14, and accordingly blowing must be continuous.

It will be appreciated by those skilled in the art that many modifications may be made within the scope of the present invention without departing from the spirit thereof, and the invention includes all such modifications.

What I claim is:

1. In a device for individually separating drop wires or heddles bunched into packs and mounted on heddle slide rails, using individually separating means associated with the individual packs by the intermediary of which the foremost drop wire or heddle of a pack first is lifted a discrete extent from the pack and then is moved into a position for drawing-in a warp thread, and including a pair of blow tubes displaceable parallel to the pack and rotatable about their longitudinal axes with suction nozzles arranged at bent-around ends of said blow tubes, the improvement comprising a blow nozzle (12*a*) in at least one of said blow tubes (12), said blow nozzle being located in the bent-around end of the respective blow tube (12) and directed along the direction of advance (V) of the heddle (6) or drop wire, and an oppositely directed suction nozzle (14) inserted as an ejector nozzle (2) into said blow nozzle (12*a*), whereby a blast through the respective blow tube (12) generates a suction effect at the suction nozzle (14) to lift the foremost drop wire or heddle from the pack for movement with the displaceable blow tube to a drawing-in position.

2. The device according to claim 1, wherein said suction nozzle (14) comprises a small suction nozzle tube (14) of a lesser cross-section than the respective blow tube (12), said nozzle tube (14) being inserted into the respective bent-around end from the outside to pass through the wall of the blow tube (12) of larger cross-section at its point of curvature and extending within the blow tube (12) approximately to the end of the curvature of said bent-around end.

3. The device according to claim 1, further including an accessory magnet (15) mounted at an effective outer end of said suction nozzle (14) for aiding in the separation of a heddle or drop wire from said pack.

4. The device of claim 1, wherein said separating means comprise a rotatable tubular guide member (8) axially displaceable in parallel to said pack, said blow tube (12) extending longitudinally through said tubular guide member (8), a carrier arm (13) rigidly mounted on the respective tubular guide member (8) for rotation and axial displacement with said tubular guide member (8), and magnetic means (16, 16') mounted on said carrier arm (13) for transporting a heddle or drop wire from said pack to said drawing-in position, said magnetic means being located behind said suction nozzle (14), as viewed from said pack, for becoming effective after said suction nozzle has separated a drop wire or heddle from said pack.

5. The device of claim 4, wherein said magnetic means (16, 16') comprise a ring magnet, said suction nozzle (14) extending through said ring magnet, said suction nozzle having a suction end extending substantially to a plane defined by a surface of said ring magnet facing said pack.

6. The device of claim 4, wherein said blow tube (12) is mounted inside said tubular guide member (8) for axial displacement with said tubular guide member through a first common displacement range and for axial displacement relative to said tubular guide member through a second separate displacement range, whereby an effective end of said suction nozzle carried by said blow tube (12) is movable from a position close to said magnetic means to a position in front of said pack for separating a heddle or drop wire from said pack.

* * * * *